US011628588B2

(12) United States Patent
Sheldon

(10) Patent No.: US 11,628,588 B2
(45) Date of Patent: Apr. 18, 2023

(54) ADJUSTABLE WOODWORKING SQUARING JIG

(71) Applicant: WoodCraft Solutions LLC, Oregon City, OR (US)

(72) Inventor: Dwight Sheldon, Oregon City, OR (US)

(73) Assignee: Woodcraft Solutions LLC, Oregon City, OR (US)

( * ) Notice: Subject to any disclaimer, the term of this patent is extended or adjusted under 35 U.S.C. 154(b) by 361 days.

(21) Appl. No.: 16/947,404

(22) Filed: Jul. 30, 2020

(65) Prior Publication Data

US 2022/0032490 A1 Feb. 3, 2022

(51) Int. Cl.

| | |
|---|---|
| ***B27C 5/06*** | (2006.01) |
| ***B27F 5/02*** | (2006.01) |
| *B43L 7/02* | (2006.01) |

(52) U.S. Cl.

CPC ..... *B27C 5/06* (2013.01); *B27F 5/02* (2013.01); *B43L 7/02* (2013.01)

(58) Field of Classification Search

CPC ..... B27C 5/06; B27F 5/02; B43L 7/02
See application file for complete search history.

(56) References Cited

U.S. PATENT DOCUMENTS 3,085,344 A * 4/1963 Tucker ..... B43L 7/02 33/446
4,742,856 A * 5/1988 Hehr ..... B27F 1/005 144/353
4,934,422 A * 6/1990 Hempy ..... B27F 5/023 269/297
5,103,880 A * 4/1992 Rice ..... B27M 3/18 144/134.1
2012/0009383 A1* 1/2012 Hardesty ..... B27G 13/14 144/241

(Continued)

FOREIGN PATENT DOCUMENTS

WO WO-8403863 A1 * 11/1984
WO WO-2011020156 A1 * 2/2011 ..... B43L 7/005

OTHER PUBLICATIONS

Family Handyman, 13 Dirt-Simple Woodworking Jigs You Need, posted at familyhandyman.com, © 2021 Home Service Publications, Inc., [online], [site visited Apr. 1, 2021], 12 pages, available from Internet, <URL:https://www.familyhandyman.com/list/dirt-simple-woodworking-jigs-you-need/>.

(Continued)

*Primary Examiner* — Omar Flores Sanchez
(74) *Attorney, Agent, or Firm* — Howard Russell, Attorney at Law

(57) ABSTRACT

Adjustable, handheld, woodworking squaring jig that is stable, versatile, and easily maneuvered for the rapid and precise squaring of jointed cuts of varying size across various workpieces which can be used in various work environments, the jig being freely adapted to move across an axis of motion as to accommodate mortise and hinge plate notch cuts of varying sizes, the jig also having a plurality of clamping surfaces which allow it to be conveniently secured to a variety of workpieces and surfaces in different positions, as well as a plurality of slots which allow for the attachment of index clamps, screws or bolts to firmly attach the jig to itself and the mortise or notch cut to be squared.

19 Claims, 10 Drawing Sheets

(56) References Cited

U.S. PATENT DOCUMENTS

| | | | | |
|---|---|---|---|---|
| 2017/0320354 | A1* | 11/2017 | Brown | B43L 7/14 |
| 2020/0130118 | A1* | 4/2020 | Sheldon | B23Q 3/007 |

OTHER PUBLICATIONS

Trend, Trend Lock/JIG/B Adjustable Trade Lock Jig for Mortice Lock and Latch Faceplates, posted atamazon.com, © 1996-2021, Amazon.com, Inc. or its affiliates, [online], [site visited Apr. 1, 2021], 6 pages, available from Internet, <URL:https://www.amazon.com/Trend-LOCK-JIG-Adjustable-Black/dp/B00I0CA8XO/ref=sr_1_5?dchild=1&keywords=squaring+jig&qid=1617149551&sr=8-5>.

* cited by examiner

ADJUSTABLE WOODWORKING SQUARING JIG

FIELD

The invention relates to a tool in the art of woodworking for producing squared cuts, and more particularly it relates to a tool for squaring rounded corner mortise cuts, dado cuts, groove cuts, and other cuts which are made by transforming rounded corner cuts to squared corner cuts having 90-degree angles.

BACKGROUND

In the art of woodworking, it is common to produce a final product from component portions, or workpieces. Therefore, it is often necessary to interconnect such product component portions using joinery components (e.g., mortise and tenon, dado, dovetail, box joint, tongue and groove, etc.).

One of the most common types of joints used for furniture joinery is the mortise and tenon. Mortises may be cut using a number of different tools, such as drills, routers, mortisers, mortising attachments for drill presses, mortising chisels, and other handheld tools to bore out the cut. However, with many of these tools, and especially with handheld tools, it can be difficult to produce mortise cuts which are consistently the same size and shape. Therefore, there have been provided, for example, pantograph-type routers which have greatly simplified the process of cutting uniform and precision joinery, but in the case of mortise and tenon joinery, for example, cutting a mortise with rounded corners is the norm.

Therefore, while the pantograph-type routers, in particular, are most easily capable of cutting precision rounded-corner mortises, e.g., as is common in the case of a stadium-shaped mortise cut, in those frequent cases where a squared mortise and tenon would be desirable, it has been difficult to square the rounded mortise cuts in a precise manner.

In those cases where it is desirable to have squared component joinery, as is often the case with certain popular designs of furniture, it has therefore become commonly necessary to square a mortise cut's rounded corners that were precisely created by a router. In other cases, it has become necessary to square rounded hinge plate notch cut-outs, for example to accommodate rectangular hinge plates for hanging doors in door frames. In the past, these types of squaring operations have been difficult to perform accurately.

A squared woodworking joint may be desirable from an appearance perspective, and it is also important that male and female joinery components be cut to relatively close tolerances for purposes of stability of the joint. Therefore, in order to produce high-quality wood products, it is necessary to produce wood product components having joinery components, whether rounded or square, which closely correspond to each other in size and shape to avoid unnecessary motion among the various pieces in the workpiece and provide a final product with a sturdy construction. Inexact joint cuts result in low quality pieces of furniture or other wood products which are wobbly and unmarketable. But because these male and female cuts must precisely correspond to each other in shape and size in order to fit tightly together, cutting accurate joints on workpieces can be difficult, time-consuming, and prone to errors.

Thus, there remains a need in the wood working industry for an improved, handheld, and easily maneuverable tool which allows for the rapid and precise squaring of mortise and hinge plate notch cuts across different workpieces of varying sizes, and which also allows for the squaring of such cuts of different shapes and sizes using the same tool.

SUMMARY

The squaring jig disclosed herein in accordance with one or more embodiments and aspects of the disclosure addresses the lacking in prior art tools to easily create precisely squared joinery cuts with an easily maneuverable tool, with the disclosure of a novel handheld tool for consistently producing precisely squared cuts in workpieces of varying size and in numerous work environments.

In accordance with a first embodiment and aspect of the disclosure, there is provided a squaring jig for use in woodworking comprising a generally L-shaped first jig portion having a lateral member, which is preferably generally rectangular, and an upper transverse member, which is also preferably generally rectangular, the lateral member and the upper transverse member being interconnected at a 90-degree angle, the lateral member having an inner surface, an outer surface, and an end surface, the upper transverse member having an upper surface, a lower surface, an inner surface, and an outer surface, wherein the upper transverse member defines a slot normal to and extending through the upper surface and the lower surface, wherein the upper transverse member defines one of a guide tongue protrusion and a groove.

The jig further comprises a generally L-shaped second jig portion having a lateral member, which is preferably generally rectangular, and a lower transverse member, which is also preferably generally rectangular, the lateral member and the lower transverse member being interconnected at a 90-degree angle, the lateral member having an inner surface, and outer surface, and an end surface, the lower transverse member having an upper surface, a lower surface, an inner surface, and an outer surface, wherein the lower transverse member defines a slot normal to and extending through the upper surface and the lower surface, wherein the lower transverse member defines another of one of a guide tongue protrusion and a groove adapted for moveable, or slidable, surface to surface mating with the generally L-shaped jig portion.

The jig further comprises a securing member to secure the first jig portion and the second jig portion together when the guide tongue protrusion is at least partially within the groove and the slots are at least partially aligned along their longitudinal length, and at least one clamping portion adapted for being clamped to a table, fixture, or the workpiece by a woodworking clamp and extending outwardly from one of the lower transverse member, the upper transverse member, the lateral member of the first jig portion, and the lateral member of the second jig portion.

The groove of the squaring jig is preferably adapted for at least partially receiving the guide tongue protrusion in a slidable relationship when the slots are at least partially aligned. The upper transverse member and the lower transverse member of each L-shaped jig may be thinner than their respective interconnected lateral members, and the upper surfaces of the lateral members and the upper surface of the upper transverse member may be coplanar when the squaring jig is assembled.

Each the first jig portion and the second jig portion may also comprise a lower surface, wherein the lower transverse member is thinner than the lateral members, and the lower surface of the lower transverse member and the lower surfaces of the first jig portion and the second jig portion member may be coplanar when the squaring jig is assembled.

Optionally, the lower transverse member of the jig may further comprise a raised platform coextensive with the upper transverse member when the groove is within the guide tongue and the slots are aligned. Further, the raised platform of the lower transverse member and the lower surface of the upper transverse member may at least partially engage each other when the groove is at least partially within the guide tongue and the slots are at least partially aligned.

In another embodiment and aspect of the disclosure, the jig securing member may further comprise a tightenable and releasable index clamp comprising a shaft having first and second ends, one of a handle, knob, socket, or head, connected at the first end of the shaft, and a key connected at the second end of the shaft, the shaft adapted for passing through each the slot of the upper transverse member and the slot of the lower transverse member when the slots are aligned. In such an embodiment, at least one clamping portion may be adapted for extending outwardly from each outer surface of the lower transverse member, the outer surface of the upper transverse member, the end surface of the lateral transverse member of the first jig portion, and the end surface of the lateral transverse member of the second jig portion.

In accordance with another aspect and embodiment of the disclosure, the at least one clamping portion may comprise a plurality of clamping portions, one clamping portion extending from the outer surface of the lower transverse member, another clamping portion extending from the end surface of the lateral member of the first jig portion, and still another clamping portion extending from the end surface of the lateral member of the second jig portion, the squaring jig being adapted for being secured in position relative to a mortise or other cut using woodworking clamps for clamping one or more clamping portions onto the workpiece, a table or other environment, such as a door frame.

In accordance with another aspect and embodiment of the disclosure, the inner surfaces of the first and second lateral members may be adapted for being sized to alignment with inner wall portions of a mortise by closing each of the lateral members of the first jig portion and the second jig portion onto a tenon that fits into the mortise, the inner surface of the upper and lower transverse members being aligned with an end wall portion of the mortise.

In another embodiment and aspect of the disclosure, at least one of the first and second lateral members may define a slot normal to and extending through the inner and outer surfaces of the first lateral member and the second lateral member for securing the squaring jig to lateral sides of a mortise cut. Preferably, both the first and second lateral members may each define a slot normal to and extending through the inner and outer surfaces of the first lateral member and the second lateral member, and further comprising a plurality of tabbed releasable index clamps, each tabbed releasable index clamp comprising a shaft having first and second ends, a handle (knob, socket, or head) connected at the first end of each shaft, and a removable or pivotable tab-like key connected at the second end of each shaft, each shaft adapted for passing through a corresponding slot of each the first lateral member and the second lateral member, each tab-like key on each corresponding shaft being adapted for being clamped upon actuating of each corresponding handle such that a tab-like key engages each inner surface of the first and second lateral members and a side surface of the mortise to hold the squaring jig in position relative to the mortise.

In yet another embodiment, there is provided a squaring jig for use in woodworking comprising a generally L-shaped first jig portion having a lateral member, which is preferably generally rectangular, and an upper transverse member, which is also preferably generally rectangular, the lateral member and the upper transverse member being interconnected at a 90-degree angle, the lateral member having an inner surface, an outer surface, and an end surface, the upper transverse member having an upper surface, a lower surface, an inner surface, and an outer surface, wherein the upper transverse member defines a slot normal to and extending through the upper surface and the lower surface. The jig further comprises a generally L-shaped second jig portion comprising a lateral member, which is generally preferably rectangular, and a lower transverse member, which is also generally preferably rectangular, the lateral member and the lower transverse member being interconnected at a 90-degree angle, the lateral member having an inner surface, and outer surface, and an end surface, the lower transverse member having an upper surface, a lower surface, an inner surface, and an outer surface, wherein the lower transverse member defines a slot normal to and extending through the upper surface and the lower surface.

In addition, this embodiment may further comprise, the lower surface of the upper transverse member preferably having a guide tongue protrusion, and wherein the upper surface of the lower transverse member comprises a groove adapted for at least partially receiving the guide tongue in a slidable relationship when the slots are at least partially aligned, a tightenable and releasable index clamp comprising a shaft having first and second ends, a handle, knob, socket, or head, connected at the first end of the shaft, and a preferably pivotable key connected at the second end of the shaft, the shaft adapted for passing through each the slot of the upper transverse member and the slot of the lower transverse member when at least a portion of the guide tongue is located within the groove, when the slots are at least partially aligned, and at least one clamping portion adapted for being clamped to a workpiece, table surface or other fixture by a woodworking clamp and extending outwardly from one of the lower transverse member, the upper transverse member, the lateral member of the first jig portion, and the lateral member of the second jig portion. It will be appreciated that, concerning the guide tongue protrusion and the groove, or similar members, they may be oriented in a different configuration, essentially any male and female configuration, either as described above, or in an opposing configuration with the lower transverse member having a guide protrusion member thereon and the upper transverse member having the groove member therein, without departing from the true scope and spirit of the invention as claimed.

The upper transverse member and the lower transverse member of each L-shaped jig preferably may be thinner than their respective interconnected lateral members, and the upper surfaces of the lateral members and the upper surface of the upper transverse member may be coplanar when the squaring jig is assembled. Each the first jig portion and the second jig portion may also comprise a lower surface, wherein the lower transverse member is thinner than the lateral members, wherein the lower surface of the lower transverse member and the lower surfaces of the first jig portion and the second jig portion are coplanar when the squaring jig is assembled, and wherein the inner surfaces of the first jig portion lateral member, the second jig portion lateral member, and the upper and lower transverse members, are adapted for being sized to alignment with inner wall portions and an end wall portion of a mortise by closing the lateral members of respective first and second jig portions onto a tenon that fits into the mortise and by sliding the inner surfaces of the upper and lower transverse members to be aligned with an end wall portion of the tenon that is fit into the mortise. After the first and second jig portions are thus adjusted to fit to the tenon and clamped in place relative to the tenon, the tenon is then advantageously removed to allow for squaring of the mortise cut. Additionally, the first jig portion and the second jig portion may be slidably adjustable relative to one another along an axis defined by the guide tongue and the groove.

The squaring jig in accordance with one or more aspects and embodiments of the disclosure may be adapted for use on a woodworking table with woodworking clamps for squaring a mortise with rounded portions cut into a workpiece, wherein said at least one clamping portion preferably comprises a plurality of clamping portions, one clamping portion extending from the outer surface of the lower transverse member, another clamping portion extending from the end surface of the lateral member of the first jig portion, and still another clamping portion extending from the end surface of the lateral member of the second jig portion, said plurality of clamping portions of the squaring jig being adapted for being secured in position relative to the mortise using the woodworking clamp for clamping the squaring jig onto the workpiece, table, and/or other fixture.

In accordance with an embodiment, each of the lateral members may each define a slot normal to and extending through the inner and outer surfaces of each of the first and second lateral members, and wherein said second securing means comprises a plurality of tabbed releasable index clamps, each tabbed releasable index clamp comprising a shaft having first and second ends, a handle, socket, or knob connected at the first end of each shaft, and a removable, or pivotable or otherwise moveable or positionable tab-like key connected at the second end of each shaft, each shaft adapted for passing through a corresponding slot of each the lateral members, each tab-like key on each corresponding shaft being adapted for being clamped upon actuating of each corresponding handle such that a tab-like key engages each inner surface of each of the lateral members and a side surface of the mortise to hold the squaring jig in position relative to the mortise.

Further, with respect to multiple embodiments, the upper transverse member and lower transverse member may be composed of any of polycarbonate, PLA, PA, TPE, HIPS, ABS, PVA, PET, aluminum, metal alloy or steel and the squaring jig may be adapted for the insertion of a chisel at, near, or adjacent an engagement region of the upper transverse member and the lower transverse member, to allow for squaring of a mortise cut on a workpiece. The upper, lower, and transverse members may be produced from these materials by 3D printing, modeling, casting, milling, or other commercially available methods known within the art of manufacturing.

The subject matter of the present disclosure is particularly pointed out and distinctly claimed in the concluding portion of this specification. However, both the organization and method of operation, together with further advantages and objects thereof, may best be understood by reference to the following descriptions taken in connection with accompanying drawings wherein like reference characters refer to like elements.

BRIEF DESCRIPTIONS OF DRAWINGS

Figure 7:
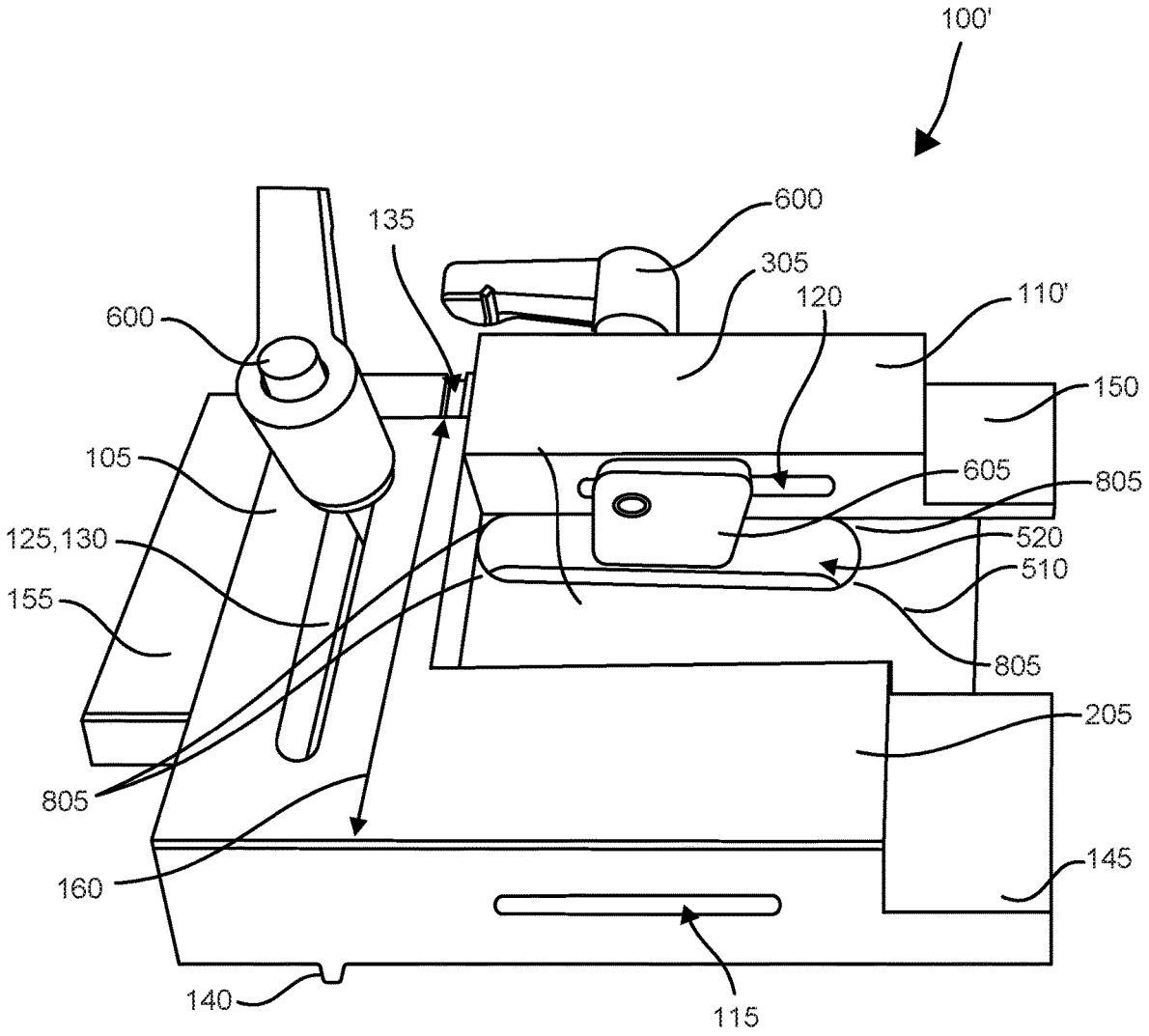
Figure 8:
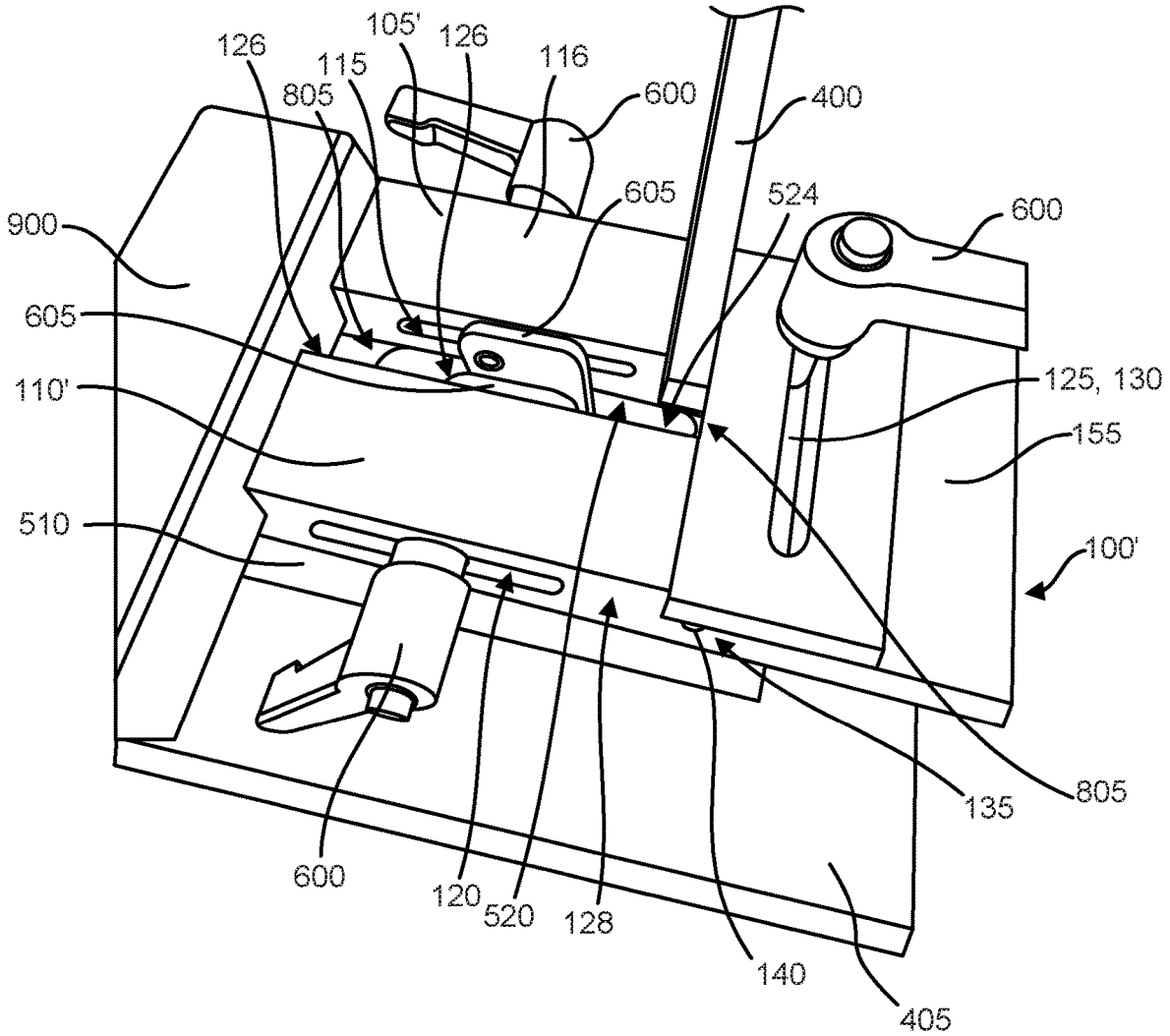
Figure 9:
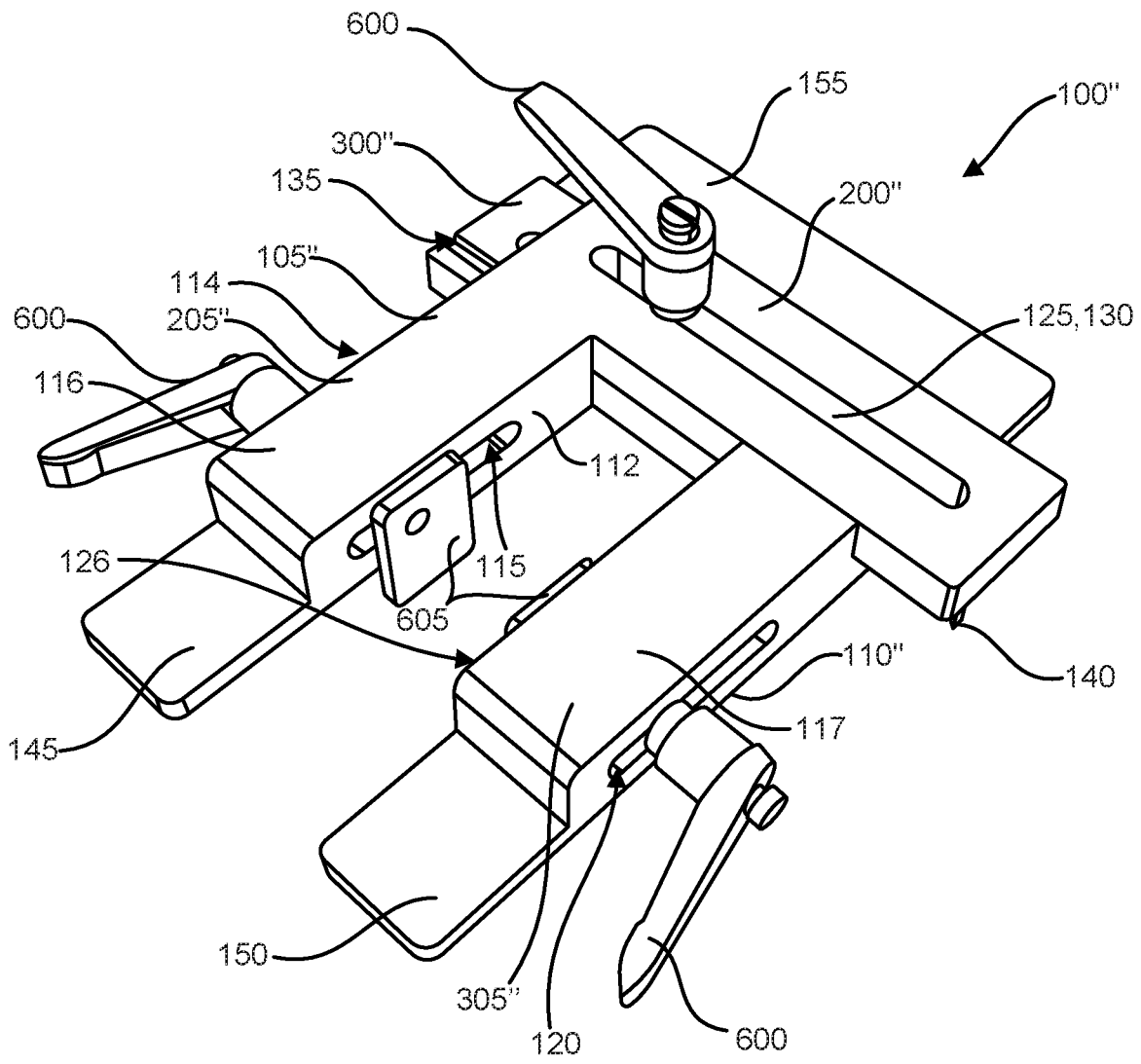
Figure 10:
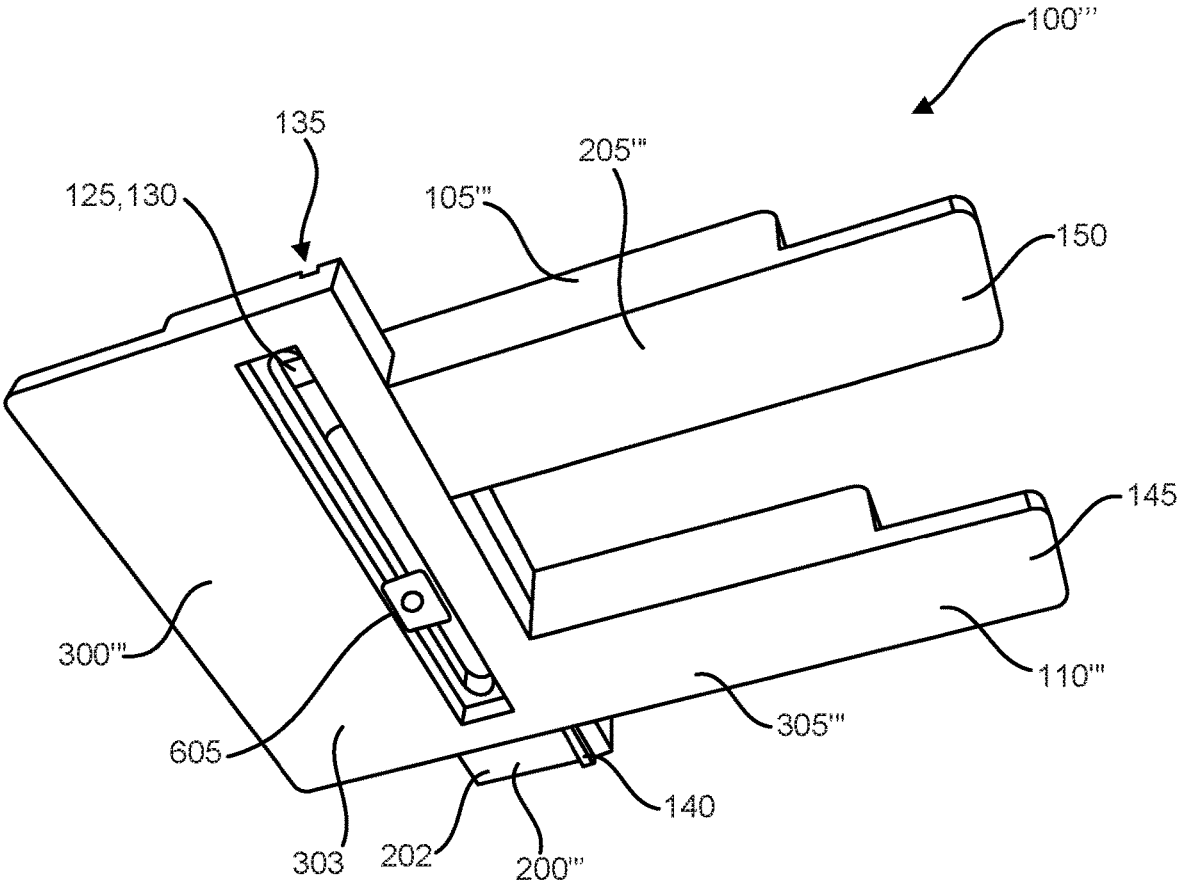

FIG. 7 shows a top front perspective view of an alternative embodiment squaring jig assembly having lateral portion slots and with a plurality of index clamps, one index clamp fixing first and second portions of the jig together, and another index clamp partially aligning the jig assembly to a workpiece as might be the case having partially installed the jig assembly on the workpiece and/or fixed to a table or other fixture;

FIG. 8 shows a top rear perspective view of the alternative embodiment squaring jig assembly of FIG. 7, but with yet another index clamp aligning, and in this case fixing, the jig relative to a workpiece, wherein the jig and workpiece are also clamped to a table with a woodworking clamp;

FIG. 9 shows a top rear perspective view of yet another alternative embodiment of a squaring jig assembly having longer transverse portions as may be helpful for larger squaring operations and with three index clamps, one for fixing first and second portions of the jig together, and two others for aligning and fixing lateral portions of the jig relative to a mortise or other cut; and FIG. 10 shows a bottom right perspective view of still another embodiment of a squaring jig, having longer transverse portions, and including an index clamp for interconnecting the squaring jig portions to each other.

DETAILED DESCRIPTION

Squaring operations for mortise cuts and other rounded cuts using prior art devices have been difficult to perform accurately. Responsive to the shortcomings of the prior art, disclosed is an improved, handheld, and easily maneuverable tool which allows for the rapid and precise squaring of mortise, hinge plate notch, and other cuts across different workpieces of varying sizes, using the same tool.

Figure 1:
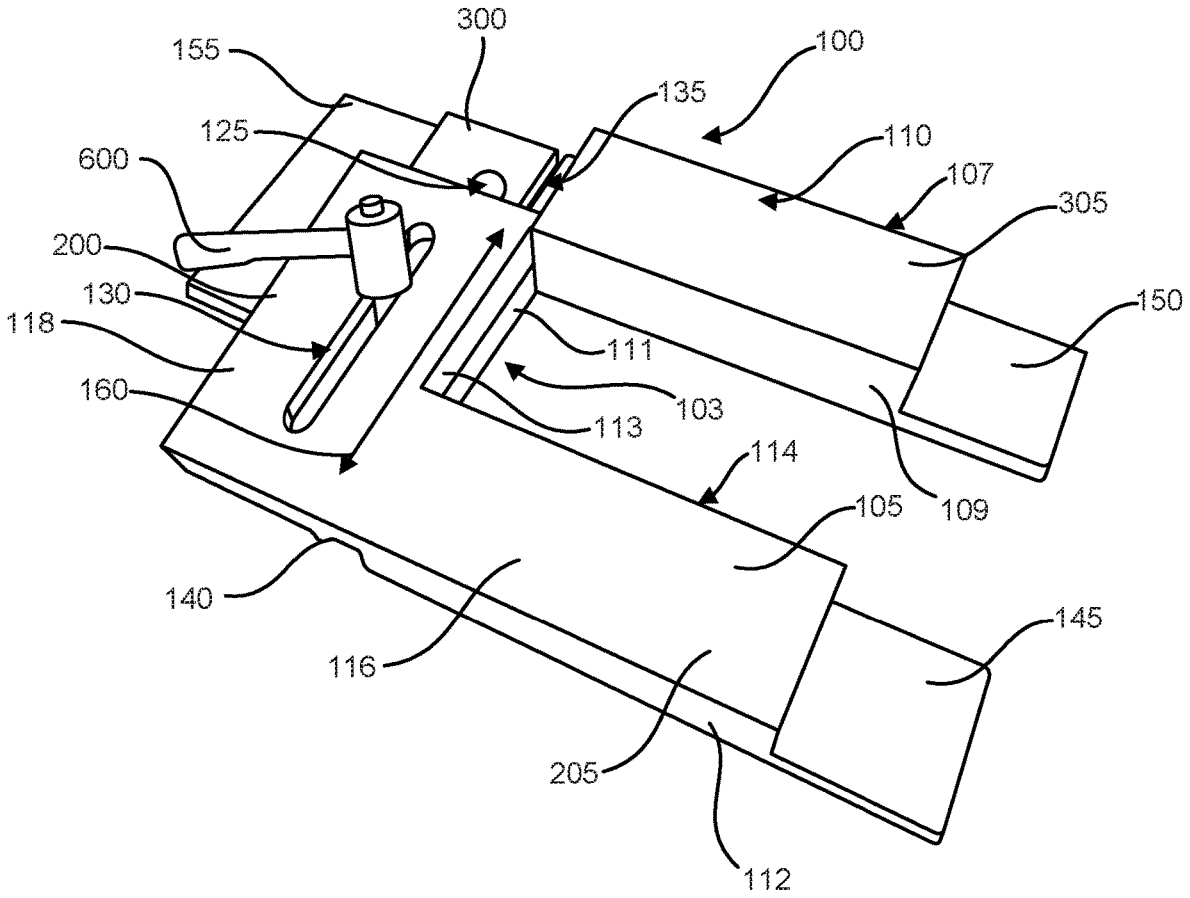
FIG. 1 shows a top right front perspective view of a first embodiment of a squaring jig assembly, assembled as it may be just before use.
Figure 2:
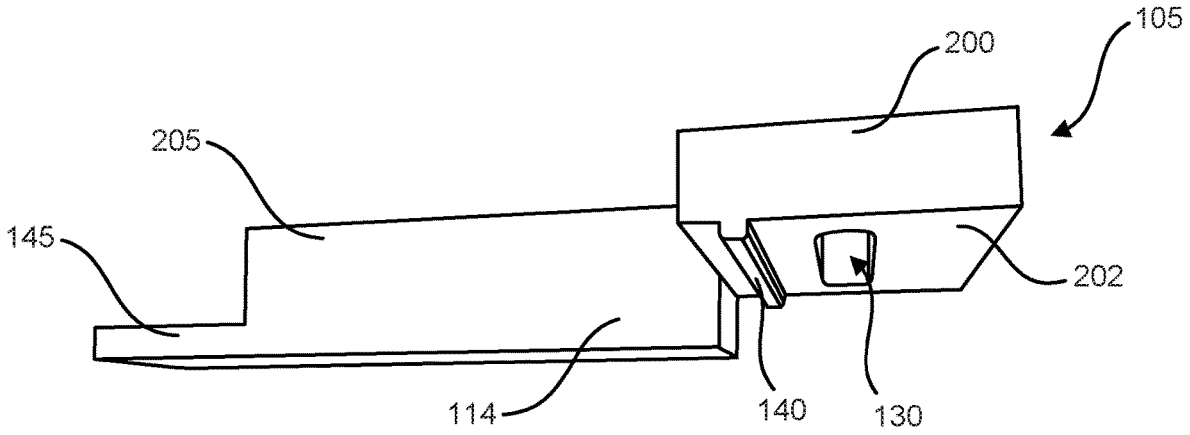
FIG. 2 shows a bottom rear perspective view of the generally L-shaped first jig portion of the squaring jig of FIG. 1.
Figure 3:
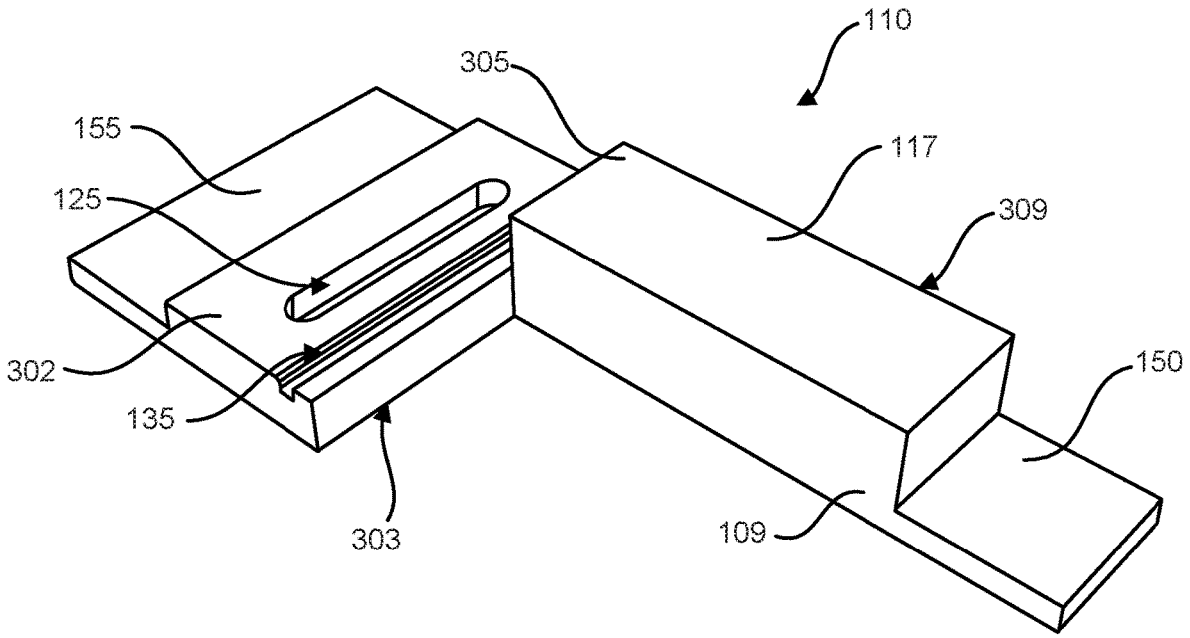
FIG. 3 shows a top right front perspective view of the generally L-shaped second jig portion of the squaring jig of FIG. 1.

Referring to FIGS. 1-3, there is shown a first embodiment of a squaring jig assembly 100. FIG. 1 shows a top right front perspective view of the squaring jig assembly 100, assembled as it might be just before use. The squaring jig assembly 100 is comprised of a generally L-shaped first jig portion 105 which partially sits on top of, or overlaps, a generally L-shaped second jig portion 110. The generally L-shaped jig portions 105, 110 partially overlap each other to form a partial rectangular shaped interior portion 103 with precise 90-degree angles. Depending on the particular application, the squaring jig assembly 100 will be secured on top of a workpiece (e.g., workpiece 510 of FIG. 5), with a rounded cornered mortise cut 520 of the workpiece 510 to be squared sitting within the partially rectangular shaped interior portion 103 created by the generally L-shaped first and second jig portions 105, 110.

Referring now also to FIG. 2, the first jig portion 105 comprises a generally rectangular lateral member 205 and a generally rectangular upper transverse member 200, which connect at a 90-degree angle to form the L-shaped jig portion 105. The L-shaped first jig portion 105 further comprises a guide tongue protrusion 140, a passage, or slot, 130, and a lateral clamping portion 145. The guide tongue protrusion 140 protrudes from a bottom surface 202 of the upper transverse member 200, and it is designed to engage with, and slide within, a corresponding groove 135 on the second L-shaped jig portion 110 (see FIGS. 1 & 3). The passage 130 is defined through the upper surface 118 and lower surface 202 of the upper transverse member 200, and it may run most of the length of the upper transverse member. The lateral clamping portion 145 is positioned at an end of the rectangular lateral member 205 opposite the transverse member 200, and it may have a lower vertical profile relative to the rectangular lateral member to allow for easy attachment of a clamp (e.g., clamp 530 of FIG. 4).

Referring now to FIG. 3, shown is a top right perspective view of the L-shaped second jig portion 110. The second jig portion 110 comprises a generally rectangular lateral member 305 and a generally rectangular lower transverse member 300 which connect at a 90-degree angle to form the L-shaped jig portion 110. The L-shaped second jig portion 110 preferably further comprises a receiving groove 135, a passage, or slot, 125, a lateral clamping portion 150, and a transverse clamping portion 155. The receiving groove 135 is positioned on an upper surface 302 of the lower transverse member 300, and it is adapted to engage slidably with the corresponding guide tongue protrusion 140 on the upper transverse portion 200 of the L-shaped first jig portion 105 (see FIGS. 1 & 2). The passage, or slot, 125 is defined directly through the upper surface 302 and a lower surface, 303 of the lower transverse member 300, and it may run most of the length of the lower transverse member. The lateral clamping portion 150 is positioned at an end of the rectangular lateral member 305 opposite the lower transverse member 300, and it may have a lower vertical profile relative to the rectangular lateral member 305 to allow for easy attachment of a clamp 530 to clamp the squaring jig assembly 100 to a workpiece, fixture or a work table. The transverse clamping portion 155 is positioned at an end of the lower transverse member 300 opposite the lateral member 305, and it may have a lower vertical profile relative to both the lower transverse member 300 and the rectangular lateral member 305, as to allow for easy attachment of a clamp 530 to a workpiece, a work table, or other fixture. The three clamping portions 145, 150, 155 may be coplanar and have the same height.

Referring again to FIG. 1, the upper transverse portion 200 of the L-shaped first jig portion 105 sits on top of the lower transverse portion 300 of the L-shaped second jig portion 110, with the guide tongue protrusion 140 of the upper transverse portion 200 slidably fitting into the receiving groove 135 of the lower transverse portion 300. Thus, the receiving groove 135 defines an axis of slidable motion 160 wherein the first jig portion 105 can slide relative to the second jig portion 110 to allow for adjustment of the size of the rectangular shaped interior 103 to allow for the jig 100 to accommodate rounded cuts and workpieces of varying size.

Figure 6:
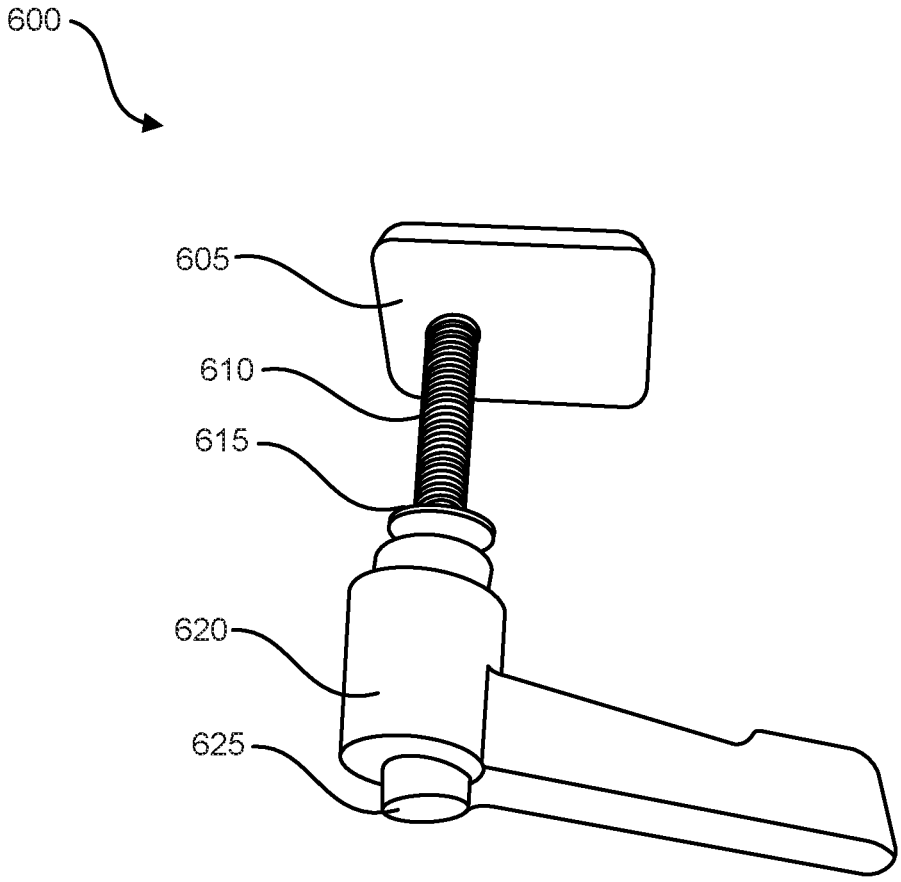
FIG. 6 shows a perspective view of an index clamp which may be used with the squaring jig assembly of present embodiments.

FIG. 6 shows a perspective view of an index clamp 600 known in the art which may be used with the squaring jig assembly 100 of present embodiments (as well as later described squaring jig assembly embodiments 100', 100", 100'"), both to fix the first L-shaped portion 105 and the second L-shaped portion 110 relative to each other, and also to allow alignment and fixing of the squaring jig assembly relative to a mortise cut 520. Each index clamp 600 (and there may be multiple such index clamps used in connection with a given squaring jig assembly as further shown and described herein) is a tightenable and releasable clamp comprising a shaft 610 having first and second ends, wherein the shaft may be threaded to allow for micro adjustments of the clamp, a tabbed key 605 located at the far end of the shaft which releasably connects to the shaft or is otherwise deformable relative to the shaft, a handle 620 at the near end of the shaft which is adapted to releasably tighten and loosed the clamp along the shaft, a secondary clamping surface 615—such as a washer—at the base of the handle for contacting the squaring jig and providing a level surface through which to transfer the force applied by the clamp, and a release 625 located on the top of the handle for releasing the clamp. The release 625 may be a button, lever, socket, or other structure which will allow the clamp to be loosened and removed. The tabbed surface 605 located at the far end of the shaft may screw into the threads of the shaft 610, or otherwise moveably and/or releasably attached to the shaft.

Figure 4:
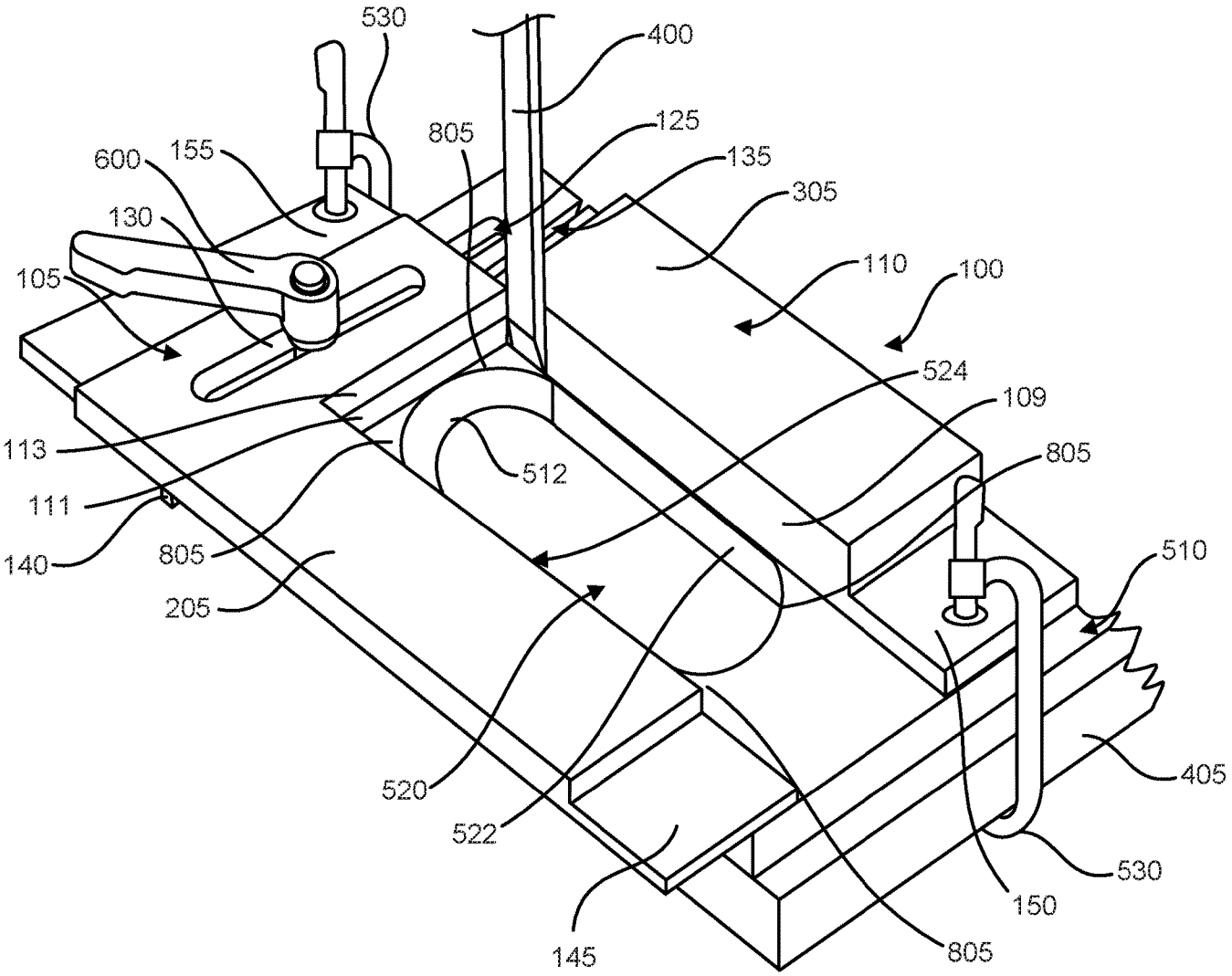
FIG. 4 shows a top right front perspective view of the squaring jig assembly of FIG. 1, wherein the squaring is assembled and placed on top of a mortise cut to be squared.

Once a workpiece (e.g., workpiece 510) has been placed into the squaring jig assembly 100 and the jig assembly 100 has been adjusted to align with the mortise or other cut in the workpiece by sliding the first jig portion 105 along the axis of motion 160 relative to the second jig portion 110, whereupon the position of the squaring jig assembly along the axis of motion 160 can be fixed by inserting and tightening an index clamp through slots 130, 125 defined in the overlapping portions of the upper and lower transverse portions 200, 300 of the first and second jig portions 105, 110, respectively. Thereafter, with this embodiment of the jig assembly 100, the jig assembly as a whole may be secured to a workpiece, work table, or other fixture or surface (see work table 405 of FIG. 4) using clamps 530 on or more of the clamping surfaces 145, 150, 155 to create a secure and immovable assembly that will allow for the accurate squaring of rounded cuts 520, even upon striking with a chisel or other tool 400 exerting significant force onto the workpiece 510. FIG. 4 shows a perspective view of the squaring jig assembly of present embodiments on top of a mortise cut 520 to be squared. Similar to that shown in FIG. 1, the upper and lower transverse portions 200 and 300 of each first and second L-shaped jig portion overlap, with the guide tongue 140 of the upper transverse portion engaging the receiving groove 135 of the lower transverse jig portion. The at least partially overlapping passages, or slots, 125, 130 on the upper and lower transverse portions 200, 300 allow for the upper and lower transverse portions to be secured along the axis of motion 160, since an index clamp or knob 600 may be threaded through the partially overlapping passages, or slots, and tightened down to secure, or fix, the upper and lower transverse portions relative to each other. And since each rectangular lateral jig portion 205, 305 of each L-shaped first and second lateral jig portion 105, 110, respectively, is independently preferably integral with corresponding upper and lower transverse portions 200, 300, this securing, fixing, or clamping feature as to the transverse portions also serves to fix the rectangular lateral jig portions 205, 305 to each other, and hence the L-shaped first and second lateral jig portions 105, 110, to each other. Thus, the L-shaped first and second jig portions 105, 110 may be adjusted along the axis of motion 160 such that inner surfaces 109, 114 are coextensive with flat edges 522, 524 of a stadium-shaped mortise cut 520 to be squared. Further, inner surfaces 111, 113 of lower and upper transverse portions 300, 200 may be positioned such that these surfaces are aligned coextensive with an adjacent rounded extent of the stadium-shaped mortise cut 520 to be squared.

These actions will thus situate the rounded edges of the mortise cut adjacent the 90-degree angles created by the first and second jig portions 105, 110, such that the rounded mortise cut can be made into a perfectly squared cut by using a chisel 400 guided by the rectangular form 103 defined by the squaring jig portions to cut and knock out the rounded corners 805 at the 90-degree angles. Because the inner surfaces 114, 109 of the L-shaped jig portions 105, 110 are coextensive with the flat edge of the mortise cut 520 to be squared, the new square edges will align with the flat edges of the preexisting curved mortise cut.

Figure 5:
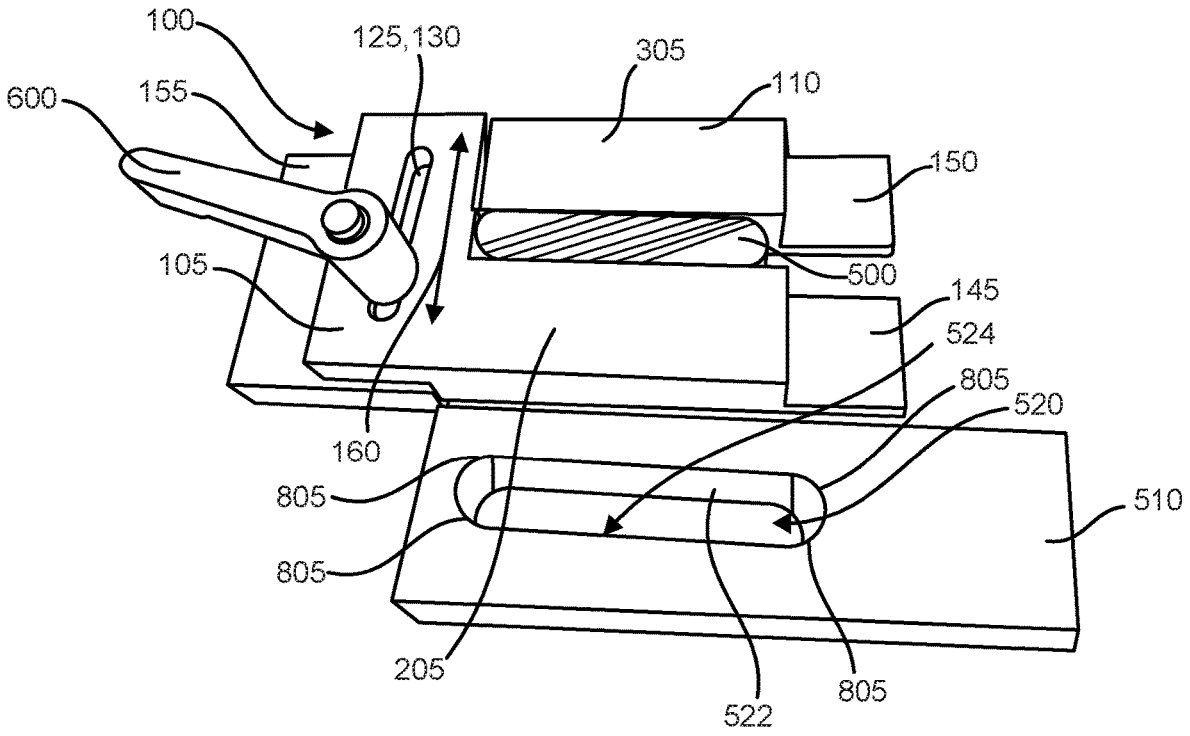
FIG. 5 shows a top front perspective view of the squaring jig assembly of FIG. 1, with the axis of motion for adjusting the jig displayed, and adjusted to size using a tenon cut which corresponds to a mortise cut.

FIG. 5 shows a top view of the squaring jig 100 with the jig assembly adjusted to size by reducing the distance between the squaring jig lateral portions 105, 110 to the size of a tenon cut 500 which corresponds to a width of a mortise cut 520. The tenon cut 500 is a male cut which corresponds to a female mortise cut, and it is the desired size and shape to fit into the mortise cut to create a furniture joint.

Thus, the squaring jig assembly 100 may also be adjusted to size as described above by using a tenon cut 500 which corresponds to a mortise cut 520 to be squared. When adjusting the jig assembly 100 using this method, the corresponding tenon cut 500 is placed in the rectangular shaped interior portion 103 created by the first jig portion 105 and the second jig portion 110, with the first and second jig portions 105, 110 being adjusted along the axis of motion 160 to closely fit to the corresponding tenon cut 500. The position of the jig assembly 100 can then by fixed by inserting an index clamp 600 through the overlapping passages 125, 130 on the upper and lower transverse portions 200, 300 of the first and second jig portions 105, 110, respectively, and then removing the corresponding tenon cut 500.

Once the jig assembly 100 has been adjusted to size in this way, it may then be placed on top of the workpiece 510 with the corresponding mortise cut 520 to be squared located with an ultimate extent of the rounded portion 512 of a stadium-shaped mortise cut being aligned with surfaces 111, 113 within the rectangular shaped interior 103 of the jig assembly 100. The clamping surfaces 145, 150, 155 may then be used to secure the jig assembly to the workpiece 510, and the mortise cut may then be squared using a tool such as a chisel 400, guided by inner surfaces 109, 111, 113, 114 to remove the rounded corners 805 of the mortise cut 520.

Referring now to FIGS. 7-9, there is provided another embodiment of a squaring jig assembly 100' that is similar to squaring jig assembly 100, except that squaring jig 100 has a plurality of slots 115, 120, as further described below, enabling alignment and fixing of the squaring jig assembly to inner sides of a mortise cut 520 using a plurality of index clamps 600.

FIG. 7 shows a perspective view of the squaring jig assembly 100' in accordance with this embodiment, and similar to squaring jig assembly 100, this embodiment provides for an index clamp 600, and a receiving groove 135 and guide tongue protrusion 140 combination, for aiding in fixing the jig's L-shaped portions 105', 110' relative to each other via slots 125, 130 in respective upper and lower transverse portions 200, 300 of the squaring jig assembly. Thus, there is a passage, or slot, 115 through inside and outside surfaces 112, 114 of the rectangular lateral member 205 of the first L-shaped squaring jig portion 105, the slot being positioned parallel to the upper surface 116 of the rectangular lateral member 205, and the slot may run most of the length of the rectangular lateral member. As to the second L-shaped squaring jig portion 110, there is a passage, or slot, 120 through inside and outside surfaces 126, 128 of the rectangular lateral member 305, the slot being positioned parallel to the upper surface 117 of the rectangular lateral member 305, and the slot may run most of the length of the rectangular lateral member.

As shown in FIG. 7, the squaring jig assembly 100' on a workpiece 510 is depicted as though it were partially installed with the shaft portion 610 of a transverse index clamp 600 (as shown and described in connection with FIG. 6) passing through slot 115 of rectangular lateral member 305 to align the squaring jig assembly on the workpiece and relative to mortise cut 520, before another index clamp 600 is installed via the other slot 120 in rectangular lateral member 205 for aligning and fixing the squaring jig assembly to the workpiece.

Thus, during installation, the squaring jig assembly 100' can be adjusted to size relative to the mortise cut 520, and an index clamp 600 can be used to fix the positional width of the squaring jig 100' along its slidable axis of motion 160 by inserting the index clamp 600 through the overlapping passages, or slots, 125, 130 on the upper and lower transverse jig portions 105', 110', and then tightening the index clamp to apply a compressive force sandwiching the upper transverse portion 200 and the lower transverse jig portion 300, to fix the first and second squaring jig portions 105', 110' (which are each preferably formed integrally with the upper transverse and lower transverse portions, respectively) in place relative to each other.

To install the index clamp 600 through a passage, or slot, 115, 120, 125, 130, the shaft 610 thereof is first inserted through the slots or passages, and then the index tab 605 is attached to the shaft (or the index tab is otherwise deformable so as to be able to pass through the slot), and then the index clamp 600 is tightened by turning the handle 625 or using a tool such as with a screwdriver or a wrench. Index clamps can also be used to secure the squaring jig assembly 100 to a mortise cut 520 and to adjust the size of the squaring jig to fit the mortise cut 520 as further shown in FIG. 8.

In accordance with this embodiment and aspects of the disclosure, the workpiece 510 can be secured to the squaring jig assembly 100' using the passages, or slots, 115, 120 through the sides of the rectangular lateral members 205, 305 on the first and second jig portions 105, 110. This is accomplished by inserting an index clamp 600 through each of the first passages 115, 120, and the index tab 605 may be aligned coextensive with straight wall portion 522, 524 of the mortise cut 520 to be squared. In this way the mortise cut 520 may be held precisely at an edge of the jig 100' such that the rounded corners 805 to be squared will line up exactly with 90-degree corners of the first and second jig portions 105, 110 so that the inner walls 109, 111, 113, 114 of the jig 100' may serve as guides to the chisel.

As shown in FIG. 8, a jig assembly 100' in accordance with the second embodiment may be clamped to a workpiece 510 and worktable 405. Thus, there is shown an L-shaped first jig portion 105' partially on top of the L-shaped second jig portion 110', with the guide tongue protrusion 140 of the first jig portion 105' fixed into place in the receiving groove 135 of the second jig portion 110' wherein the first and second jig portions 105', 110' are secured together by an index clamp 600 passed through the at least partially overlapping passages 125, 130. The clamping surfaces 145, 150 are used to secure the squaring jig assembly 100' to the worktable 405 with another type of a woodworking clamp 900 (wherein the clamping surfaces 145, 150 are preferably coplanar), and this Figure also shows how other index clamps 600 are used, passing through slots 115, 120, respectively, to align and even secure jig portions 105', 110' to inner walls 522, 524 of a mortise 520.

While present embodiments describe the adjustability of the squaring jig assembly 100, 100', 100", 100'" using a tongue 140 and groove 135, the adjustability of the of the squaring jig assembly is not limited to a tongue and groove mechanism. Thus, for example, it is conceivable that the tongue 140 and groove 135 mechanism may be replaced with a rack and pinion-type mechanism without departing from the scope of the invention as claimed.

Thus, as described previously, the index clamps or screws 600 are inserted through the slots or passages 115, 120 on the sides of the rectangular lateral members 205, 305, respectively, on the first and second lateral jig portions 110', 105', and the index tabs 605 of each index clamp 600 are secured within the mortise cut 520 to be squared. The index clamps 600 are then tightened such that the straight edge of the mortise cut 520 are coextensive with the index tabs 605, and this in turn adjusts the jig assembly 100' along its slidable axis of motion to be exactly the width mortise cut 520. In such an embodiment, the rounded corners 805 of the mortise cut 520 to be squared, will align at 90-degree angles created by the first and second lateral jig portions 110', 105', together with upper and lower transverse portions 200, 300, respectively. After one set of rounded corners 805 are squared off in this way using a chisel guided by the jig assembly 100', the jig assembly may be turned around and re-installed at the other end of the mortise 520 to be squared, so that in this way it is possible to square both rounded corners 805 without readjusting the jig.

FIG. 9 shows a rear right perspective view of an alternative embodiment squaring jig assembly 100". The squaring jig assembly 100" is very similar to the squaring jig assembly 100', except that the transverse portions 200", 300" of squaring jig 100" are longer to accommodate application of the squaring jig 100" for squaring larger mortises and other cuts, thus enhancing the number of situations in which the squaring jig assembly may be used. Like squaring jig assembly 100', squaring jig assembly 100" comprises a plurality of slots 115, 120, as further described below, enabling alignment and fixing of the squaring jig assembly to inner sides of a mortise cut 520 using a plurality of index clamps or screws 600 as described above.

Similar to squaring jig assembly 100 and 100', this embodiment 100" also provides for an index clamp 600, and a receiving groove 135 and guide tongue protrusion 140 combination, for aiding in fixing the jig's L-shaped portions 105", 110" relative to each other via slots 125, 130 in respective upper and lower transverse portions 200", 300" of the squaring jig assembly. Similar to a previous embodiment, there is a passage, or slot, 115 through inside and outside surfaces 112, 114 of the rectangular lateral member 205" of the first L-shaped squaring jig portion 105", the slot being positioned parallel to the upper surface 116 of the rectangular lateral member 205", and the slot may run most of the length of the rectangular lateral member. As to the second L-shaped squaring jig portion 110", there is a passage, or slot, 120 through inside and outside surfaces 126, 128 of the rectangular lateral member 305", the slot being positioned parallel to the upper surface 117 of the rectangular lateral member 305, and the slot may run most of the length of the rectangular lateral member.

Squaring jig assembly 100" is installed as previously described in connection with squaring jig assembly 100', wherein the index clamps 600 used in connection with this embodiment of the disclosure would operate in similar fashion to the same clamps as described above.

Thus, in accordance with this embodiment and aspects of the disclosure, the workpiece 510 can be secured to the squaring jig assembly 100" using the passages, or slots, 115, 120 through the sides of the rectangular lateral members 205", 305" on the first and second jig portions 105", 110". This is accomplished by inserting an index clamp 600 through each of the first passages 115, 120, and the index tab 605 may be aligned coextensive with straight wall portion 522, 524 of the mortise cut 520 to be squared. In this way the mortise cut 520 may be held precisely at an edge of the jig 100" such that the rounded corners 805 to be squared will line up exactly with 90-degree corners formed at 103 of the first and second jig portions 105", 110" so that the inner walls 109, 111, 113, 114 of the jig 100" may serve as guides to the chisel. The clamping surfaces 145, 150, 155 are used to secure the squaring jig assembly 100" to a worktable 405 and/or workpiece as described previously.

FIG. 10 shows a bottom right front perspective view of a fourth alternative embodiment of a squaring jig assembly 100'" without lateral slots (similar to the first embodiment of squaring jig assembly 100), but wherein like the third embodiment of the squaring jig assembly 100", the transverse portions 200', 300' of squaring jig 100' are longer to accommodate application of the squaring jig 100'" for squaring larger mortises and other cuts, thus enhancing the number of situations in which the squaring jig assembly may be used.

As with squaring jig assembly 100, squaring jig assembly 100' comprises a generally L-shaped first jig portion 105' which partially sits on top of, or overlaps, a generally L-shaped second jig portion 110'. The generally L-shaped jig portions 105'", 110'" partially overlap each other to form a partial rectangular shaped interior portion 103 with precise 90-degree angles. Depending on the particular application, the squaring jig assembly 100' will be secured on top of a workpiece (e.g., workpiece 510 of FIG. 5), with a rounded corner mortise cut 520 of the workpiece to be squared sitting within the partially rectangular shaped interior portion 103 created by the generally L-shaped first and second jig portions 105'", 110'.

The L-shaped first jig portion 105'" comprises a generally rectangular lateral member 205'" and a generally rectangular upper transverse member 200'", which connect at a 90-degree angle to form the L-shaped jig portion 105'. The L-shaped first jig portion 105'" further comprises a guide tongue protrusion 140, a passage, or slot, 130, and a lateral clamping portion 145. The guide tongue protrusion 140 protrudes from a bottom surface 202 of the upper transverse member 200'", and it is designed to engage with, and slide within, a corresponding groove 135 on the second L-shaped jig portion 110'". The passage, or slot, 130 is defined through upper and lower surfaces of the upper transverse member 200'", similarly to that described in connection with embodiment 100, and the passage, or slot, may run most of the length of the upper transverse member. The lateral clamping portion 145 is positioned at an end of the rectangular lateral member 205'" opposite the transverse member 200'", and it may have a lower vertical profile relative to the rectangular lateral member to allow for easy attachment of a clamp.

The L-shaped second jig portion 110''' comprises a generally rectangular lateral member 305''' and a generally rectangular lower transverse member 300''' which connect at a 90-degree angle to form the L-shaped jig portion 110''. The L-shaped second jig portion 110''' preferably further comprises a receiving groove 135, a passage, or slot, 125, a lateral clamping portion 150, and a transverse clamping portion 155. The receiving groove 135 is positioned on an upper surface 302 of the lower transverse member 300''', and it is adapted to engage slidably with the corresponding guide tongue protrusion 140 on the upper transverse portion 200''' of the L-shaped first jig portion 105'''. The passage, or slot, 125 is defined directly through the upper surface 302 and a lower surface, 303 of the lower transverse member 300''', and it may run most of the length of the lower transverse member. The lateral clamping portion 145 is positioned at an end of the rectangular lateral member 305''' opposite the lower transverse member 300''', and it may have a lower vertical profile relative to the rectangular lateral member 305''' to allow for easy attachment of a woodworking clamp 530 to clamp to a workpiece 510 or a work table 405. The transverse clamping portion 155 is positioned at an end of the lower transverse member 300''' opposite the rectangular lateral member 305''', and it may have a lower vertical profile relative to both the lower transverse member 300''' and the rectangular lateral member 305''', as to allow for easy attachment of a woodworking clamp 530 to a workpiece 510 or a work table 405. The three clamping portions 145, 150, 155 may be coplanar and have the same height.

The upper transverse portion 200''' of the L-shaped first jig portion 105''' sits at least partially on top of the lower transverse portion 300''' of the L-shaped second jig portion 110''', with the guide tongue protrusion 140 of the upper transverse portion 200''' slidably fitting into the receiving groove 135 of the lower transverse portion 300'''. Thus, the receiving groove 135 defines an axis of slidable motion 160 wherein the first jig portion 105''' can slide relative to the second jig portion 110''' to allow for adjustment of the size of the rectangular shaped interior 103 to allow for the jig 100''' to accommodate rounded cuts and workpieces of varying size.

The squaring jig assembly of present embodiments may be fabricated using a variety of different manufacturing techniques known within the art which are suitable for production of tools, including casting, molding, 3D printing, and other methods. The jig may be composed of a variety of materials including metal, composite materials, plastics, polymers, polycarbonate, PLA, PA, TPE, HIPS, ABS, PVA, PET, aluminum, metal alloy steel, and others.

In the preceding description, numerous details were set forth. It will be apparent, however, to one skilled in the art, that the present invention may be practiced without some of these specific details. Additionally, one of ordinary skill in the art will recognize the inventive principles disclosed are not limited to the embodiments disclosed herein, and that various aspects of the disclosed embodiments can be combined to achieve yet additional embodiments. In some instances, well-known structures and devices are shown in block diagram form, rather than in detail, in order to avoid obscuring the present invention.

I claim:

1. A squaring jig for use in woodworking, comprising:

a generally L-shaped first jig portion comprising a generally rectangular lateral member and a generally rectangular upper transverse member, the lateral member and the upper transverse member being interconnected at a 90-degree angle, the lateral member having an inner surface, an outer surface, and an end surface, the upper transverse member having an upper surface, a lower surface, an inner surface, and an outer surface, wherein the upper transverse member defines a slot normal to and extending through the upper surface and the lower surface, wherein the upper transverse member defines one of a guide tongue protrusion and a groove;

a generally L-shaped second jig portion comprising a generally rectangular lateral member and a generally rectangular lower transverse member, the lateral member and the lower transverse member being interconnected at a 90-degree angle, the lateral member having an inner surface, an outer surface, and an end surface, the lower transverse member having an upper surface, a lower surface, an inner surface, and an outer surface, wherein the lower transverse member defines a slot normal to and extending through the upper surface and the lower surface, wherein the lower transverse member defines another of one of a guide tongue protrusion and a groove adapted for moveable mating with the generally L-shaped first jig portion;

a securing member to secure the first jig portion and the second jig portion together when the guide tongue protrusion is at least partially within the groove and the slots are at least partially aligned along their longitudinal length; and further comprising at least one clamping portion adapted for being clamped to at least one of a table, a workpiece, and another fixture by a woodworking clamp and extending outwardly from one of the lower transverse member, the upper transverse member, the lateral member of the first jig portion, and the lateral member of the second jig portion.

2. The squaring jig of claim 1, wherein the groove is adapted for at least partially receiving the guide tongue protrusion in a slidable relationship when the slots are at least partially aligned.

3. The squaring jig of claim 2, wherein the upper transverse member and the lower transverse member of each L-shaped jig is thinner than their respective interconnected lateral members, and wherein the upper surfaces of the lateral members and the upper surface of the upper transverse member are coplanar when the squaring jig is assembled.

4. The squaring jig of claim 2, wherein each the first jig portion and the second jig portion also comprise a lower surface, wherein the lower transverse member is thinner than the lateral members, and wherein the lower surface of the lower transverse member and the lower surfaces of the first jig portion and the second jig portion member are coplanar when the squaring jig is assembled.

5. The squaring jig of claim 1, the lower transverse member further comprising a raised platform coextensive with the upper transverse member when the groove is within the guide tongue and the slots are aligned.

6. The squaring jig of claim 5, wherein the raised platform of the lower transverse member and the lower surface of the upper transverse member at least partially engage each other when the groove is at least partially within the guide tongue and the slots are at least partially aligned.

7. The squaring jig of claim 2, wherein the securing member further comprises one of a releasable index clamp and a screw comprising a shaft having first and second ends, one of a handle, a socket and a head connected at the first end of the shaft, and a key connected at the second end of the shaft, the shaft adapted for passing through each the slot of the upper transverse member and the slot of the lower transverse member when the slots are aligned.

8. The squaring jig of claim 1, wherein said at least one clamping portion is adapted for extending outwardly from each outer surface of the lower transverse member, the outer surface of the upper transverse member, the end surface of the lateral transverse member of the first jig portion, and the end surface of the lateral transverse member of the second jig portion.

9. The squaring jig of claim 8, wherein the at least one clamping portion comprises a plurality of clamping portions, one clamping portion extending from the outer surface of the lower transverse member, another clamping portion extending from the end surface of the lateral member of the first jig portion, and still another clamping portion extending from the end surface of the lateral member of the second jig portion, the squaring jig being adapted for being secured in position relative to a mortise using woodworking clamps for clamping one or more clamping portions onto a table.

10. The squaring jig of claim 9, wherein the inner surfaces of the first and second lateral members are adapted for being sized to alignment with inner wall portions of a mortise by closing each of the lateral members of the first jig portion and the second jig portion onto a tenon that fits into the mortise, the inner surface of the upper and lower transverse members being aligned with an end wall portion of the mortise.

11. The squaring jig of claim 1, wherein at least one of the first and second lateral members defines a slot normal to and extending through the inner and outer surfaces of the first lateral member and the second lateral member for securing the squaring jig to lateral sides of a mortise cut.

12. The squaring jig of claim 11, wherein the first and second lateral members each defines a slot normal to and extending through the inner and outer surfaces of the first lateral member and the second lateral member, and further comprising a plurality of tabbed releasable index clamps, each tabbed releasable index clamp comprising a shaft having first and second ends, one of a handle, a knob, a socket and a head connected at the first end of each shaft, and a removable key connected at the second end of each shaft, each shaft adapted for passing through a corresponding slot of each the first lateral member and the second lateral member, each key on each corresponding shaft being adapted for being clamped upon actuating of each corresponding handle such that the key engages each inner surface of the first and second lateral members and a side surface of the mortise to hold the squaring jig in position relative to the mortise.

13. A squaring jig for use in woodworking, comprising:

a generally L-shaped first jig portion comprising a generally rectangular lateral member and a generally rectangular upper transverse member, the lateral member and the upper transverse member being interconnected at a 90-degree angle, the lateral member having an inner surface, an outer surface, and an end surface, the upper transverse member having an upper surface, a lower surface, an inner surface, and an outer surface, wherein the upper transverse member defines a slot normal to and extending through the upper surface and the lower surface;

a generally L-shaped second jig portion comprising a generally rectangular lateral member and a generally rectangular lower transverse member, the lateral member and the lower transverse member being interconnected at a 90-degree angle, the lateral member having an inner surface, an outer surface, and an end surface, the lower transverse member having an upper surface, a lower surface, an inner surface, and an outer surface, wherein the lower transverse member defines a slot normal to and extending through the upper surface and the lower surface;

wherein the lower surface of the upper transverse member comprises one of a guide tongue protrusion and a groove, and wherein the upper surface of the lower transverse member comprises another of one of a guide tongue protrusion and a groove adapted for at least partially receiving and mating in a slidable relationship when the slots are at least partially aligned;

one of a releasable index clamp, screw and bolt comprising a shaft having first and second ends, one of a handle, a knob, a socket and a head connected at the first end of the shaft, and a key connected at the second end of the shaft, the shaft adapted for passing through each the slot of the upper transverse member and the slot of the lower transverse member when at least a portion of the guide tongue is located within the groove and when at least a portion of the slots are aligned; and further comprising at least one clamping portion adapted for being clamped to a table surface by a woodworking clamp and extending outwardly from one of the lower transverse member, the upper transverse member, the lateral member of the first jig portion, and the lateral member of the second jig portion.

14. The squaring jig, of claim 13, wherein the upper transverse member and the lower transverse member of each L-shaped jig is thinner than their respective interconnected lateral members, and wherein the upper surfaces of the lateral members and the upper surface of the upper transverse member are coplanar when the squaring jig is assembled.

15. The squaring jig, of claim 14, wherein each the first jig portion and the second jig portion also comprise a lower surface, wherein the lower transverse member is thinner than the lateral members, and wherein the lower surface of the lower transverse member and the lower surfaces of the first jig portion and the second jig portion are coplanar when the squaring jig is assembled, and wherein the inner surfaces of the first jig portion lateral member, the second jig portion lateral member, and the upper and lower transverse members, are adapted for being sized to alignment with inner wall portions and an end wall portion of a mortise by closing the lateral members of respective first and second jig portions onto a tenon that fits into the mortise and by sliding the inner surfaces of the upper and lower transverse members to be aligned with an end wall portion of the tenon that is fit into the mortise.

16. The squaring jig of claim 13, wherein the first jig portion and the second jig portion are slidably adjustable relative to one another along an axis defined by the guide tongue and the groove.

17. The squaring jig of claim 13, wherein the squaring jig is adapted for use on a woodworking table with woodworking clamps for squaring a mortise with rounded portions cut into a workpiece, wherein said at least one clamping portion comprises a plurality of clamping portions, one clamping portion extending from the outer surface of the lower transverse member, another clamping portion extending from the end surface of the lateral member of the first jig portion, and still another clamping portion extending from the end surface of the lateral member of the second jig portion, said plurality of clamping portions of the squaring jig being adapted for being secured in position relative to the mortise using a woodworking clamp for clamping the squaring jig onto one of the workpiece, the table, and a fixture.

18. The squaring jig of claim 16, wherein the first and second lateral members each defines a slot normal to and extending through the inner and outer surfaces of each of the first and second lateral members, and wherein said second securing means comprises a plurality of tabbed releasable index clamps, each tabbed releasable index clamp comprising a shaft having first and second ends, one of a handle, a knob, a socket, and a head connected at the first end of each shaft, and a key connected at the second end of each shaft, each shaft adapted for passing through a corresponding slot of each the first lateral member and the second lateral member, each key on each corresponding shaft being adapted for being clamped upon actuating of each corresponding handle such that the key engages each inner surface of the first and second lateral members and a side surface of the mortise to hold the squaring jig in position relative to the mortise.

19. The jig assembly of claim 1 wherein the upper transverse member and lower transverse member are composed of one of polycarbonate, PLA, PA, TPE, HIPS, ABS, PVA, PET, aluminum, and steel and wherein the squaring jig is adapted for the insertion of a chisel at an engagement region of the upper transverse member and the lower transverse member, to allow for squaring of a mortise cut on a workpiece.

* * * * *